United States Patent [19]

Johansson

[11] Patent Number: 4,798,018

[45] Date of Patent: Jan. 17, 1989

[54] MAGAZINE LOCKING MEANS FOR FIREARMS HAVING A MAGAZINE IN A PISTOL GRIP

[76] Inventor: Bertil Johansson, Brusensgatan 3B, S-633, 47 Eskilstuna, Sweden

[21] Appl. No.: 92,462

[22] Filed: Sep. 3, 1987

[30] Foreign Application Priority Data

Sep. 5, 1986 [SE] Sweden ..... 8603734

[51] Int. Cl.[4] ..... F41C 25/06

[52] U.S. Cl. ..... 42/7

[58] Field of Search ..... 42/7, 6, 18

[56] References Cited

U.S. PATENT DOCUMENTS

| | | | |
|---|---|---|---|
| 804,985 | 11/1905 | Searle | 42/7 |
| 954,797 | 4/1910 | Hammond | 42/18 |
| 1,168,024 | 1/1916 | Nelson | 42/7 |
| 1,226,478 | 5/1917 | Diehm | 42/7 |
| 3,372,506 | 3/1968 | Wilhelm | 42/7 |
| 3,574,264 | 4/1971 | Simmons, Sr. | 42/6 |
| 4,132,023 | 1/1979 | Weldle | 42/7 |
| 4,236,337 | 12/1980 | Beretta | 42/7 |
| 4,326,353 | 4/1982 | Ludwig et al. | 42/7 |

FOREIGN PATENT DOCUMENTS

| | | | |
|---|---|---|---|
| 279889 | 10/1914 | Fed. Rep. of Germany | 42/7 |
| 2014328 | 3/1975 | Fed. Rep. of Germany . | |
| 2618074 | 11/1977 | Fed. Rep. of Germany . | |
| 2137321 | 10/1984 | United Kingdom . | |

OTHER PUBLICATIONS (sold R Mtrl), pp. 95–96.

*Primary Examiner*—Charles T. Jordan

*Attorney, Agent, or Firm*—McCormick, Paulding & Huber

[57] ABSTRACT

Magazine locking means for firearms of the type having a pistol grip or a corresponding part to be grabbed by the firing hand of the marksman, and in which an exchangable magazine (5) is adapted to be introduced, and in which a magazine catch (9) is adapted to releasably lock the magazine a position introduced in a magazine guide of the pistol grip or in a corresponding inner position, and in which the magazine catch (9) is movable mounted (10) at the front edge of the magazine guide and is formed so as to engage (by 16 ) under a projecting part (17) at the front side of the magazine (5) when the magazine catch is in its locking position. The magazine catch is formed with an upper yoke part (12) having two grab parts (13, 14), which project on each side of the magazine guide, and which readily and without the need of changing hand grip can be actuated optionally the thumb of the left hand or the right hand for releasing the magazine.

9 Claims, 2 Drawing Sheets

MAGAZINE LOCKING MEANS FOR FIREARMS HAVING A MAGAZINE IN A PISTOL GRIP

The present invention generally relates of an improved firearm of the type having a pistol grip or a corresponding weapon part, in which an exchangable magazine is adapted to be introduced and which upon shooting is gripped by the hand of the marksman. More particularly the invention is directed to a magazine catch for firearms of the above type, in which the pistol grip at the front side thereof is formed with a so called grip safety, which has to be pulled before the weapon can be fired, and in which the magazine catch in the apparatus according to the invention is partly enclosed in said grip safety and cooperates therewith.

The invention has been made as a result of the development of hand firearms like pistols, sub machine guns and other pistol like weapons having magazines which have to be quickly exchanged, but it is obvious that the invention is as well useful also for many other types of firearms having exchangeable magazines in the part of the firearm which during shooting is gripped by the hand of the marksman, whereby a grip safety is pressed thereby releasing the weapon for firing.

In conventional firearms like a sub machine gun the magazine catch is usually located so that it can be actuated by the hand seizing the pistol grip, that is the firing hand. This makes an exchange of magazine difficult, and above all it prolonges the time needed for exchange of magazine, and this is an obvious disadvantage in critical situations. For pistols, having rather small magazine capacities, structural solutions have since long been looked for in order to provide quick exchanges of magazines. Said firearms therefore are often formed with a magazine catch which can be actuated be the thumb of the hand used for firing of the weapon at the same time as the support hand seizes and introduces a new magazine in the magazine guide of the pistol grip. The magazine catch used in such known weapons generally is placed on one side of the pistol grip, ordinarily the left side, and hence the magazine catch can be actuated by the thumb of the hand firing the weapon only by right-handed marksmen. In said known apparatus the magazine catch engages a recess provided directly in the wall of the magazine which has rather thin wall thickness. This embodiment is sufficient for small and light magazines but the structure is considered too weak for larger and heavier magazines.

The invention is intended to provide a magazine catch for the above mentioned types of firearms, which is co-ordinated to the grip safety, which can be actuated by the thumb of the firing hand both by right-handed and left-handed marksmen thereby enabling the quickest possible exchange of magazines, and which is formed for effectively holding even large and heavy magazines for instance magazines for sub machine guns.

The said objects are fulfilled by means of some few and easily manufactured pieces. The invention is mainly characterized in that the magazine catch is movably mounted at the front edge of a magazine guide and is formed so that said magazine catch, in its locked position, engages under a projecting portion of the front side of the magazine. Preferably the magazine catch is formed as a plate which is rotatably mounted about a cross pin at the lower part thereof, and which at its upper part is formed with two grab parts projecting on opposite sides of the pistol grip, whereby optionally any of the grab parts can be used for releasing the catch and letting the magazine out.

Further chatacteristics of the invention and advantages thereof will be evident from the following specification and from the appended claims.

Now the invention will be described more closely with reference to the accompanying drawings, in which FIGS. 1 and 2 show a sub machine gun seen from the left side and from the right side respectively.

Figure 1:
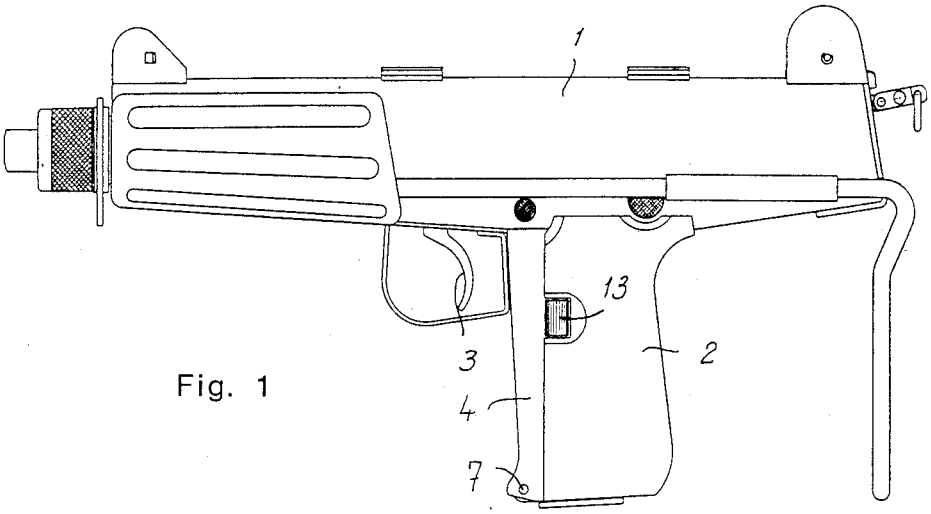
Figure 2:
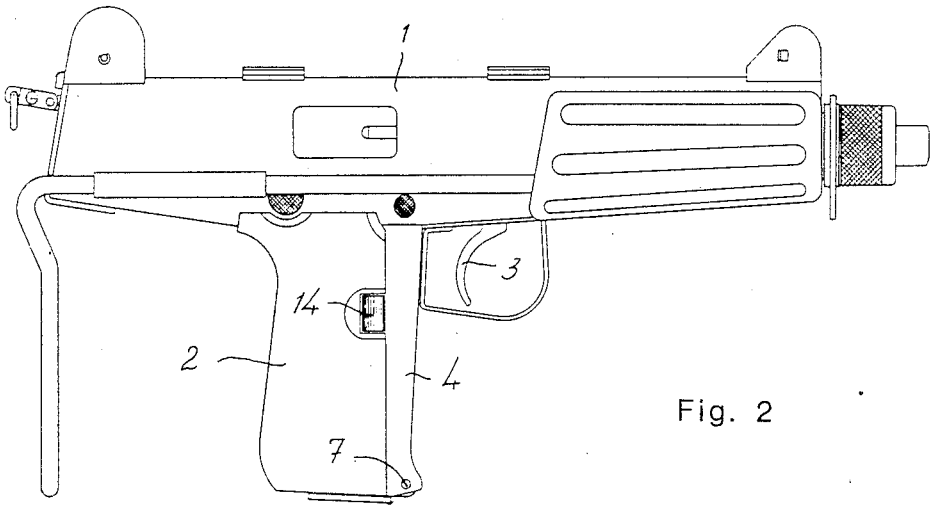
Figure 3:
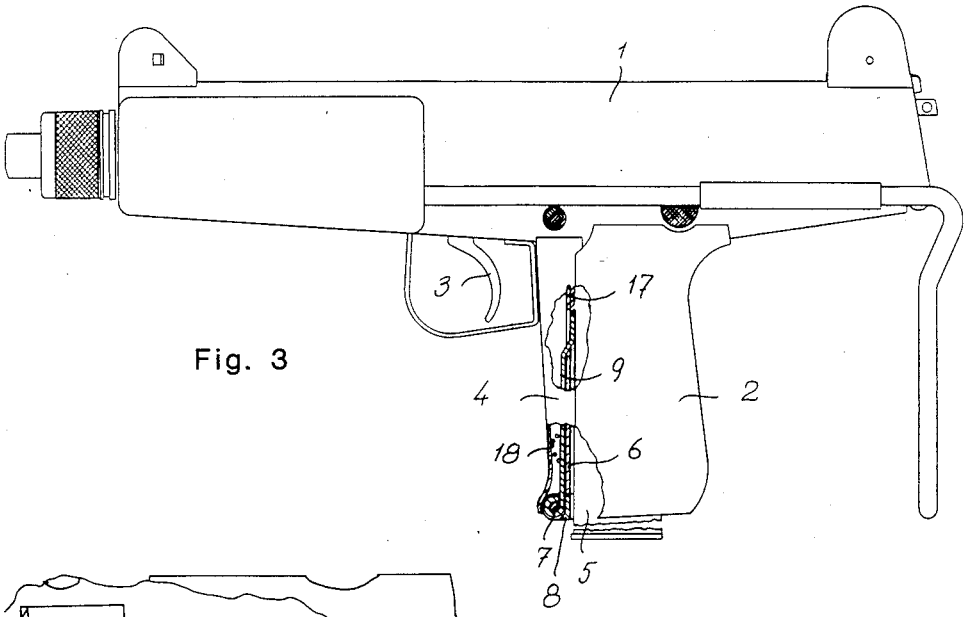
FIG. 3 shows, like in FIG. 1, a sideview of a sub machine gun, partly in a cross section view, having a magazine catch according to the invention.
Figure 4:
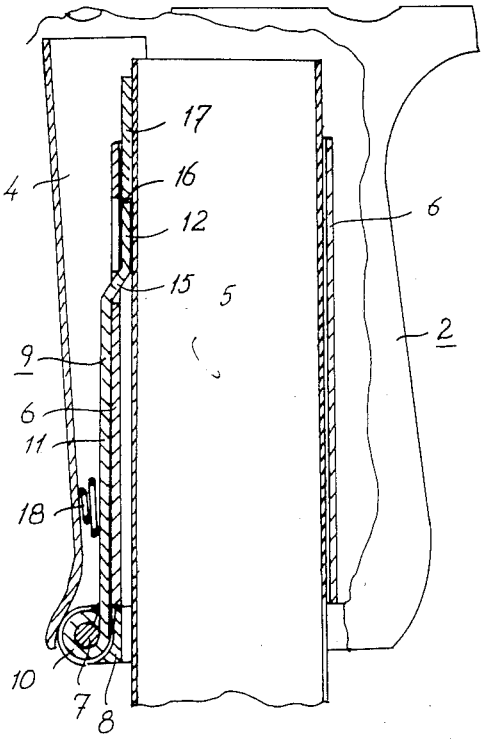
FIG. 4 shows more in detail a cross section through the magazine catch according to the invention, and the co-ordination thereof with the grip safety and the magazine.

The sub machine gun shown in FIGS. 1–3 is of known type and therefore all parts thereof will not be described in detail. The firearm comprises a receiver 1 having a not-illustrated lock bolt and a pistol grip 2 connected to the receiver 1 and having a trigger and a grip safety 4. An exchangable magazine 5 is adapted to be introduced in a magazine guide 6 provided in the pistol grip 2 and to be locked in this position by a magazine catch.

Figure 5:
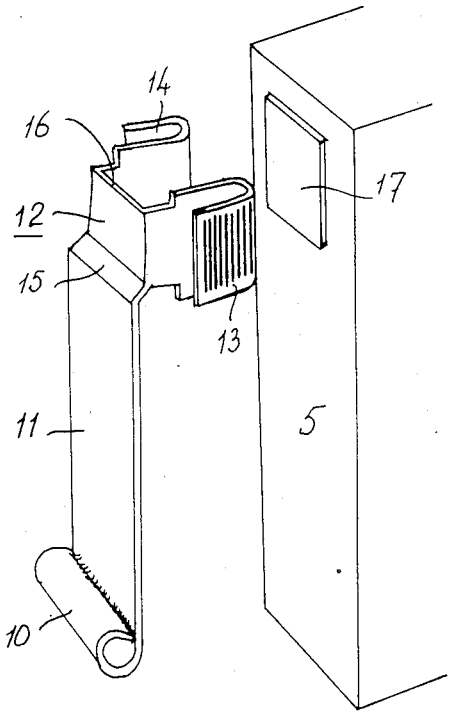
FIG. 5 is a perspective view of the magazine catch.

The grip safety 4 is in the form of a curved handle which is rotatably mounted on a cross pin 7 of a grip safety bracket 8. The magazine catch 9 is rotatably mounted on the same pin 7. As best shown in FIG. 5 the magazine catch comprises at its bottom a tubular carrier 10, an intermediate plain portion 11 over a web a yoke-formed part 12 having fold out grab portions 13 and 14. The yoke part 12 is integral with the intermediate portion 11 and at its top 15, by means of which the yoke part of the catch extends into the magazine guide 6 and into the area of magazine introduction.

The largest part of the magazine catch 9 is enclosed between the grip safety 4 and the front wall of the magazine guide 6. The upper part of the catch, which is formed as a yoke having grab parts 13 and 14 in the form of double folded plate parts projecting on opposite sides thereof, encloses the side walls of the magazine guide 6. The grab parts 13 and 14 of the catch 9 are readily accessable by the thumb of the marksman on the left side for right-handed marksmen and on the right side for left-handed marksmen. The upper edge 16 of the magazine catch 9 provides a stop edge for engagement with a lock plate 17 which is welded or otherwise fixedly mounted on the front side of the magazine.

As explained above the grip safety 4 and the magazine catch 9 are rotably or pivotally mounted on the same pin 7, and a pressure spring 18 is mounted between the grip safety 4 and the plain intermediate part 11 of the magazine catch. Said spring 18 biasses the two parts in opposite directions. The grip safety is blocked from moving forwardly by the trigger guard or any other part of the firearm, and the magazine catch, in turn, is blocked from moving rearwardly by the magazine guide, whereby the grip safety normally takes a firing blocking position and the magazine guide normally takes a magazine locking position.

For introducing a magazine 5 in the magazine guide 6 of the pistol grip the magazine is just pushed right up, whereby the upper edge thereof, by actuating the web 15 of the catch, moves the catch out until the lock plate 17 of the magazine has passed the upper edge 16 of the catch, whereby the catch snaps back and locks the magazine against the bottom edge of the lock plate 17.

For exchanging magazine the magazine catch is pressed forwardly by the thumb of the firing hand, that is the thumb of the firing hand of a right-handed marksman or of a left-handed marksman, whereby the upper edge 16 of the catch is released from the lock plate 17 of the magazine, and the magazine 5, which slides easily in its guide, drops out of the magazine guide. This can be done by using only one hand without the need of moving the hand from the pistol grip and even without moving the firearm from its adjusted firing position. With the other hand the marksman can get a new magazine and move same as far into the magazine guide that the upper edge 16 of the catch snaps into position under the lock plate 17 of the magazine.

It is to be understood that the above description and the embodiment of the invention shown in the drawings is only an illustrating example, and that many different variations and modification may be presented within the scope of the appended claims.

I claim:

1. Magazine locking means for firearms of the type having a pistol grip (2) or corresponding part which is grasped by the firing hand of a marksman and which includes a magazine guide (6) into which an exchangeable magazine (5) is introduced, and a magazine catch (9) mounted at the front side of the pistol grip (2) for movement between magazine locking and releasing positions, characterized in that said magazine catch (9) comprises a plate hingedly connected at its lower end to said pistol grip for pivotal movement between said locking and releasing positions and engageable in said locking position with a projecting part (17) at the front side of said magazine (5), said plate having grab parts (13 and 14) at the upper portion thereof projecting at opposite sides of said pistol grip (2), each of said grab parts (13 and 14) being usable independently of the other of said grab parts (13 and 14) to pivotally move said magazine catch (9) to said releasing position and release said magazine (5) from said magazine guide (6).

2. Magazine locking means according to claim 1, wherein said firearm has a grip safety (4) at the front side of the pistol grip (2) which defines the front edge of the pistol grip (2) and encloses the front edge of the magazine guide (6), characterized in that said magazine catch (9) is partially enclosed by said grip safety (4), and a spring (18) is provided which acts between said grip safety (4) and said magazine catch (9) to bias said grip safety (4) and said magazine catch (9) in opposite directions.

3. Magazine locking means according to claim 2, characterized in that said grip safety (4) and said magazine catch (9) are rotatable about a common axis at the lower front side of the magazine guide (6).

4. Magazine locking means for firearms of the type having a pistol grip (2) or corresponding part which is grasped by the firing hand of a marksman and which includes a magazine guide (6) into which an exchangeable magazine (5) is introduced and a magazine catch (9) mounted at the front side of the pistol grip (2) for movement between magazine locking and releasing positions, characterized in that said magazine guide (6) has an opening through its front side and said magazine catch (9) has a hinge portion (10) at its lower end hingedly connected to the front side of said magazine guide (6) and supporting said magazine catch for pivotal movement between said magazine locking and releasing positions, an intermediate portion (11) connected to said hinge portion (10), a yoke portion (12) at the upper part thereof and a web portion (15) connecting the intermediate portion (11) and the yoke portion (12), said yoke portion (12) being movable into said opening and into the path of introduction of a magazine (5) into said magazine guide (6).

5. Magazine locking means according to claim 4, characterized in that said yoke portion (12) has grab parts (13,14) which extend on each side of said magazine guide (6) and which form holds for releasing said magazine catch (9) from a magazine (5) retained in the magazine guide (6).

6. Magazine locking means according to claim 5, characterized in that the grab parts (13,14) of the magazine catch are readily accessable for thumb operation by the marksman both from the left side and the right side of the pistol grip (2).

7. Magazine locking means for firearms of the type formed with a pistol grip (2) or a corresponding part which is grasped by the firing hand of a marksman and which includes a magazine guide (6) into which an exchangeable magazine (5) is introduced, and a magazine catch (9) for releasably locking the magazine (5) is a position within the magazine guide (6) and movably mounted at the front side (8) of the magazine guide (6) for movement between magazine locking and magazine releasing positions, characterized in that the magazine (5) has a projecting part (17) at the front side thereof, said magazine catch (9) engages the projecting part (17) in said locking position, said firearm includes a grip safety (4) at the front side of said pistol grip (2) which forms the front edge of said pistol grip (2) and which is movable toward and away from said magazine (5), said magazine catch (9) is located between said grip safety (4) and the magazine (5), and said locking means includes a spring (18) mounted between said grip safety (4) and said magazine catch (9) for biasing said grip safety (4) and said magazine catch (9) in opposite directions with respect to each other.

8. A magazine locking means according to claim 7, characterized in that said grip safety provides an enclosure for the front of the magazine guide (6) and a portion of said magazine catch (9).

9. Magazine locking means as set forth in claim 7 wherein said grip safety (4) and said magazine catch (9) are supported to pivot about a common axis at the lower front side of said magazine guide (6).

* * * * *